US006250830B1

(12) United States Patent
Clark

(10) Patent No.: US 6,250,830 B1
(45) Date of Patent: Jun. 26, 2001

(54) DEVICE FOR MARKING DELAMINATIONS AND METHODS OF USE THEREOF

(76) Inventor: Philip Clark, 603 Farmhurst Rd., Baltimore, MD (US) 21208

( * ) Notice: Subject to any disclaimer, the term of this patent is extended or adjusted under 35 U.S.C. 154(b) by 0 days.

(21) Appl. No.: 09/493,224

(22) Filed: Jan. 28, 2000

(51) Int. Cl.[7] ..... A46B 11/00

(52) U.S. Cl. ..... 401/48; 401/138; 401/140; 401/193; 401/190; 73/866

(58) Field of Search ..... 401/48, 137, 138, 401/140, 190, 193; 172/21, 22, 371, 378; 73/588, 768, 865.9

(56) References Cited

U.S. PATENT DOCUMENTS

| | | | | |
|---|---|---|---|---|
| 1,749,326 | * | 3/1930 | Dirkes et al. | 401/48 |
| 2,022,335 | * | 11/1935 | Bernthal | 172/547 |
| 2,720,422 | * | 10/1955 | Mercur | 222/174 |
| 3,179,089 | * | 4/1965 | Civitarese | 15/3 |
| 3,361,225 | * | 1/1968 | Nichols | 73/588 |
| 3,679,319 | * | 7/1972 | Munchel et al. | 401/138 |
| 3,794,217 | * | 2/1974 | Munchel | 222/174 |

* cited by examiner

*Primary Examiner*—Henry J. Recla
*Assistant Examiner*—Huyen Le

(74) *Attorney, Agent, or Firm*—Oblon, Spivak, McClelland, Maier & Neustadt, P.C.

(57) ABSTRACT

A device for marking hidden delaminations in a structure subject to hidden delaminations comprising a wheeled spray paint can holder, wherein said holder is adapted to hold a paint can containing a nozzle which when depressed releases an upward spray of paint, and wherein said holder is fixedly connected to an outer tube containing therein an inner tube adapted for freely sliding inside said outer tube, wherein said inner tube contains a section extending beyond said outer tube in an upper axial direction, and wherein said inner tube is mounted on top of a spring in said outer tube, and wherein said inner tube contains a protrusion in said section, and wherein said inner tube contains one or more wheels, at or near the upper end of said section, for rolling said holder on an overhead surface, and wherein said outer tube contains means fixedly attached thereto for engaging said spring and located inside said outer tube and below said spring, and wherein when said outer tube is adapted through said means to connect to an extension pole through said outer tube so as to engage said spring, and wherein when said extension pole is connected in a fixed relationship to said means and is urged against said spring while said one or more wheels are in contact with said overhead surface, said protrusion is urged against said nozzle, thereby releasing said upward spray of paint.

13 Claims, 3 Drawing Sheets

DEVICE FOR MARKING DELAMINATIONS AND METHODS OF USE THEREOF

BACKGROUND OF THE INVENTION

1. Field of the Invention

This invention relates to a device for marking hidden flaws, such as delaminated areas, in a structure such as a concrete slab, and methods of using the device.

2. Discussion of the Background

Methods of and devices for detecting the presence of hidden flaws within steel reinforced suspended concrete slabs have been suggested in the prior art. The flaw to be detected is a separation, or delamination, of the layers of concrete within the slab. The delamination is caused by corrosion of the reinforcing steel within the slab. Corrosion of the steel within the suspended concrete slab is caused when moisture and chlorides make contact with the reinforcing steel. Once the steel begins to corrode, oxidation occurs and the cross-sectional dimension increases which causes areas within the concrete slab to debond and separate into two or more layers. This condition occurs in areas where there are freeze-thaw cycles as well as in areas where there is a preponderance of chlorides, either air-borne or where de-icing salts are used for roadways and bridge decks. Once the oxidation and the resultant delamination starts, the rate of deterioration accelerates until a condition exists where large concrete fragments break loose and fall, or, in severe cases, a serious compromise in structural soundness of the slab occurs. Early detection, therefore, of the unseen delamination is important to keep repair costs to a minimum.

In the past, detection of delaminations in the bottom exposed surface of a suspended concrete slab, or soffit, has been to repeatedly tap the surface, usually with a hand held hammer producing the sound which has been found to occur when the slab is delaminated. This method of initially detecting the presence of delamination is regarded as a reliable means to find problem areas which are not visually apparent. Most soffits are out of reach, so a ladder or scaffolding is usually required to reach the surface.

At the time the delamination is detected, it is both customary and necessary to then mark the delaminated area, such as with a marker for future repair. For soffits and other hard to reach places, the same ladder, scaffolding or other aid is used for the marking as well.

I have invented a relatively simple and inexpensive rotary percussion tool for detecting delaminations in structures subject to such delaminations, and particularly such structures, such as suspended concrete slabs or soffits, that have previously not been tested for delaminations without great effort. The tool and method of use thereof is the subject of U.S. patent application Ser. No. 09/413,812, filed Oct. 7, 1999, and is hereby incorporated by reference. The tool comprises a rotary percussion tool head adapted at an end thereof to connect to an extension pole, wherein said head comprises at least one circular member, each circular member having on the periphery thereof projections extending in the radial direction and spaced apart in the circumferential direction.

However, a need still exists in the art for a relatively simple and inexpensive device for marking such delaminations

SUMMARY OF THE INVENTION

It is therefore an object of the present invention to provide an improved device which is simple and inexpensive for marking delaminations in structures subject to such delaminations that heretofore were not easily subject to detection, such as suspended concrete slabs or soffits.

It is another object of the present invention to provide a method for using such a device.

The device is a wheeled paint can holder adapted at an end thereof to connect to an extension pole of any length, thus allowing contact of the wheels of the wheeled paint can holder with a surface to be marked located at various distances from the testing location, such as the ground, and allowing for an opening of the paint can holder to be in close proximity to the surface to be marked.

The above-described device can be used as part of a kit containing an extension pole and a device for detecting the location of said delaminations, preferably the above-described rotary percussion tool for detecting delaminations and described and claimed in above U.S. patent application Ser. No. 09/413,812. The kit preferably also additionally comprises a holder for premarking the location of such delaminations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

The device is a wheeled spray paint can holder adapted at an end thereof to connect to an extension pole of any length, thus allowing contact of the wheels of the wheeled spray paint can holder with a surface to be marked located at various distances from the testing location, such as the ground, and allowing for an opening of the paint can holder to be in close proximity to the surface to be marked.

Specifically, the invention is a device for marking hidden delaminations in a structure subject to hidden delaminations comprising a wheeled spray paint can holder, wherein said holder is adapted to hold a paint can containing a nozzle which when depressed releases an upward spray of paint, and wherein said holder is fixedly connected to an outer tube containing therein an inner tube adapted for freely sliding inside said outer tube, wherein said inner tube contains a section extending beyond said outer tube in an upper axial direction, and wherein said inner tube is mounted on top of a spring in said outer tube, and wherein said inner tube contains a protrusion in said section, and wherein said inner tube contains one or more wheels, at or near the upper end of said section, for rolling said holder on an overhead surface, and wherein said outer tube contains means fixedly attached thereto for engaging said spring and located inside said outer tube and below said spring, and wherein when said outer tube is adapted through said means to connect to an extension pole through said outer tube so as to engage said spring, and wherein when said extension pole is connected in a fixed relationship to said means and is urged against said spring while said one or more wheels are in contact with said overhead surface, said protrusion is urged against said nozzle, thereby releasing said upward spray of paint.

The preferred use of the device is to mark delaminated areas following the conduct of sounding analysis to determine the extent of delaminated and spalled concrete in the under side of overhead slabs or soffits. The design of the tool includes a preferably telescopic extension pole.

The overhead area on the exposed surface, such as a ceiling (or soffit) of a structure, has been examined for defects, the boundaries of which must be clearly marked for future repair. Once these boundaries have been identified, the wheeled paint can holder is rolled along the surface to be marked. The device is used to delineate an area in need of repair with a highly visible paint line.

Figures 4, 5:
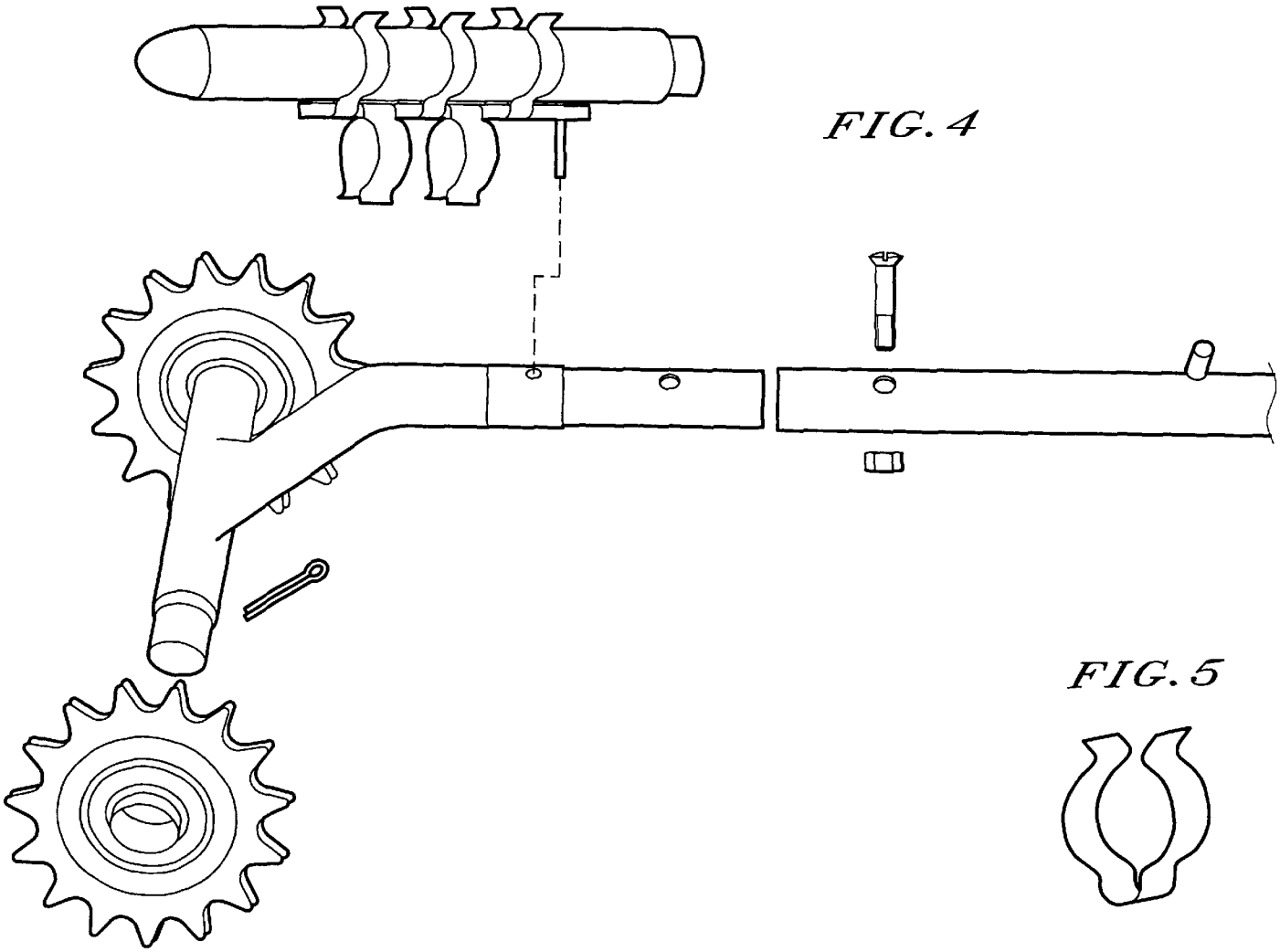
FIG. 4 represents a combination of a rotary percussive tool with holder for marking chalk.
FIG. 5 is a clamp for attaching the holder for marking chalk to the rotary percussive tool.

While detection of delaminated areas can be carried out by any of the methods known in the prior art, the wheeled spray paint-marking device of the present invention is preferably used in conjunction with the rotary percussion tool disclosed in the above-described U.S. patent application Ser. No. 09/413,812, filed Oct. 7, 1999. While examining the soffit with the rotary percussion tool and areas of delamination are found, the area is preferably first marked (premarked) with a chalk or similar marking attachment, as shown in FIG. 4, which is snapped onto the tool using one or more snaps as shown in FIG. 5, and positions a chalk stick or similar device to allow the surface to be premarked. A small chalk mark, for example, is placed at the area of delamination by turning the rotary percussion tool over, i.e., rotating it 180°, and premarking the soffit area. This allows the examination of the soffit to continue uninterrupted while chalk-marking additional areas. Once the entire study area has been examined and areas of delamination have been generally indicated by the premarks, the technician can then employ the wheeled spray paint-marking device of the present invention.

Preferably, when the present wheeled spray paint-marking device of the present invention is part of a kit, as described above, the technician can simply remove the rotary percussion tool-head attachment from the extension pole and attach the wheeled spray paint-marking device to the extension pole in order to apply a painted line to indicate a boundary of repair.

A preferred up-spraying paint can for use with the wheeled spray paint-marking device of the invention is sold under the brand name Kilz Up Shot, and is indicated as manufactured by Masterchem Industries, Inc., P.O. Box 368, Barnhart Mo. 63012.

Figure 1:
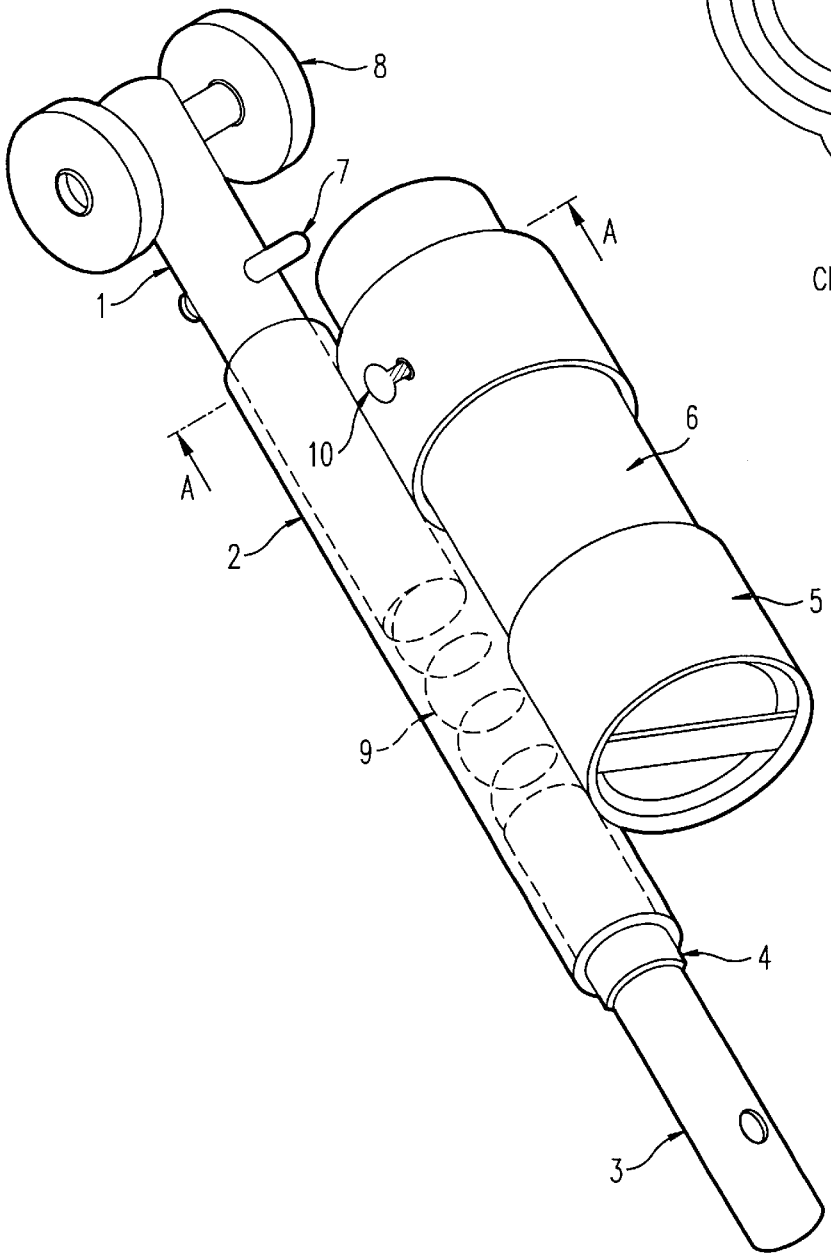
FIG. 1 represents a preferred embodiment of the device.
Figure 3:
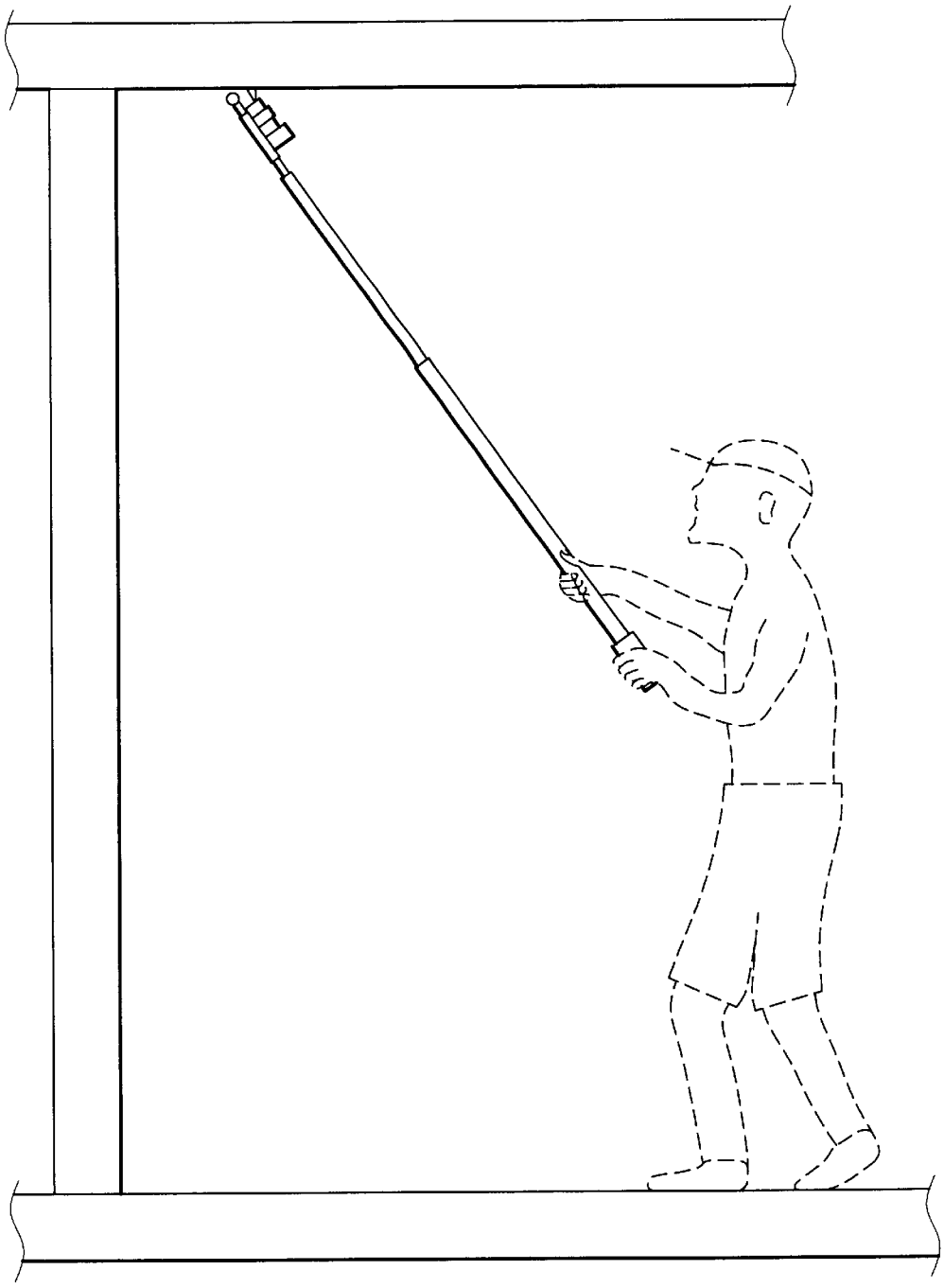
FIG. 3 demonstrates a method of using the device.

A preferred embodiment of the wheeled spray paint can holder of the present invention is shown in FIG. 1. As shown therein, the paint can is inserted into the cylindrical holder (5) and the setscrew (10) is tightened up to hold the can firmly. Cylindrical holder (5) is in a fixed relationship with outer tube (2) and inner tube (4). Inside outer tube (2) is a spring mounted on top of inner tube (4), above which is another inner tube (1) which extends beyond outer tube (2) in an upper axial direction and which is adapted to slide therein. Inner tube (1) contains a protrusion, which acts as a trigger (7), in a section in said upper axial direction above the top of said can, and also contains one or more guide wheels (8), at or near the end of said upper axial direction, for rolling said holder on an overhead surface. The entire spray paint marking assembly is connected to via adapter (3) to an extension pole, which can be one fixed length, or a series of shorter, connectable lengths, or is preferably telescopic and thus can be adjusted in length, and raised up to the level of the exposed overhead surface to be marked. (If desired, the extension pole and entire spray paint marking assembly can be structured to connect to each other without the necessity of the adapter.) Once the guide wheels (8) make contact with the exposed surface to be marked, slight upward force is applied so that the inner tube (4) slides upward against the inner spring (9), causing cylindrical holder (5) and outer tube (2) to also move upward. The trigger (7) makes contact with the paint can nozzle to release the upward spray of paint. While maintaining the slight upward force, the assembly is rolled along the exposed overhead surface, which will apply the paint mark in a straight line indicating the area in need of repair. Once the line has been applied, the upward force is released, thereby allowing the inner spring (9) to push the inner tube (4) downward, the spray paint can nozzle backs off of the trigger (7) and the paint stream stops.

Figure 2:
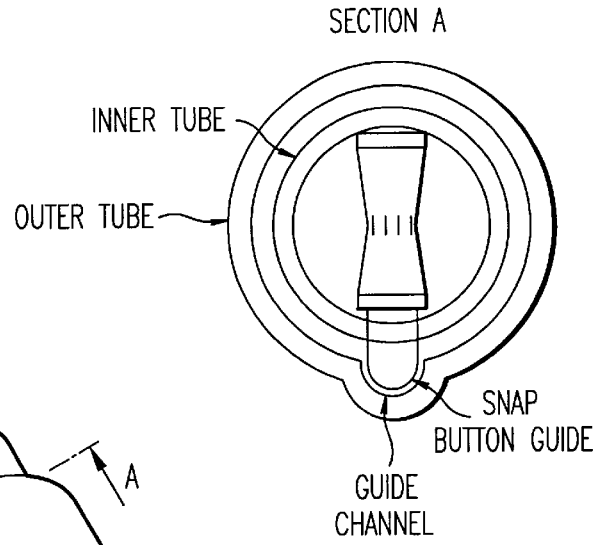
FIG. 2 represents a cross-section view of part of the embodiment of FIG. 1.

When both inner tube (1) and the outer tube are cylindrical, there is a possibility of rotation of inner tube (1) relative to the outer tube. This can create a problem of non-alignment, wherein the trigger does not align with the spray paint can nozzle when the device is operated. This problem can be avoided by constructing the respective tubes so that such rotation is avoided and the tubes remain in alignment. A preferred means of alignment is shown in FIG. 2, which is a cross-section along line A—A in FIG. 1. The tubing is made up of an inner tube with a guide button protruding therefrom. The guide button follows along the guide channel in the outer tube, which keeps the two tubes sliding along a straight line, or track. Such tubing material is manufactured by MPS Products, 2581 Jupiter Park Drive, Suite E19, Jupiter, Fla. 33458. Applicant has been told that the tubing and tracking method is patent pending by MPS Products. Other such arrangements would be immediately evident to a person of ordinary skill in the art.

Obviously, numerous modifications and variations of the present invention are possible in light of the above teachings. It is therefore to be understood that within the scope of the appended claims, the invention may be practiced otherwise than as specifically described herein.

I claim:

1. A device for marking hidden delaminations in a structure subject to hidden delaminations comprising a wheeled spray paint can holder, wherein said holder is adapted to hold a paint can containing a nozzle which when depressed releases an upward spray of paint, and wherein said holder is fixedly connected to an outer tube containing therein an inner tube adapted for freely sliding inside said outer tube, wherein said inner tube contains a section extending beyond said outer tube in an upper axial direction, and wherein said inner tube is mounted on top of a spring in said outer tube, and wherein said inner tube contains a protrusion in said section, and wherein said inner tube contains one or more wheels, at or near the upper end of said section, for rolling said holder on an overhead surface, and wherein said outer tube contains means fixedly attached thereto for engaging said spring and located inside said outer tube and below said spring, and wherein when said outer tube is adapted through said means to connect to an extension pole through said outer tube so as to engage said spring, and wherein when said extension pole is connected in a fixed relationship to said means and is urged against said spring while said one or more wheels are in contact with said overhead surface, said protrusion is urged against said nozzle, thereby releasing said upward spray of paint.

2. The device according to claim 1, wherein said means is a tube of smaller diameter than said outer tube.

3. The device according to claim 1, wherein said inner tube is not rotatable relative to said outer tube.

4. The device according to claim 3, wherein a guide button protrudes radially from said inner tube that is in alignment with a guide channel in said outer tube.

5. The device according to claim 1, connected to said extension pole through said means directly or via an adapter.

6. A method of marking hidden delaminations above a concrete soffit comprising manually rolling the device of claim 5 on a surface of said soffit and marking said delaminations at the location of the delaminations.

7. A method of detecting and marking hidden delaminations above a concrete soffit comprising manually rolling a delamination detecting device on a surface of said soffit and detecting the location of such delaminations, and then rolling the device of claim 5 holding a paint can containing a nozzle which when depressed releases an upward spray of paint, on a surface of said soffit and marking said delaminations at the location of the delaminations.

8. The method of claim 7, wherein said delamination detecting device comprises a rotary percussion tool head adapted at an end thereof to connect to said extension pole, wherein said head comprises at least one circular member, each circular member having on the periphery thereof projections extending in the radial direction and spaced apart in the circumferential direction.

9. The method of claim 8, additionally comprising premarking said delaminations after detecting and prior to rolling.

10. A kit comprising the device according to claim 1 (device A), a device for detecting the location of said delaminations (device B), and an extension pole adapted to connect to both device A and device B.

11. The kit of claim 10, wherein said device for detecting the location of said delaminations comprises a rotary percussion tool head adapted at an end thereof to connect to said extension pole, wherein said head comprises at least one circular member, each circular member having on the periphery thereof projections extending in the radial direction and spaced apart in the circumferential direction.

12. The kit of claim 11, additionally comprising a premarking attachment adapted to snap onto said a device for detecting the location of said delaminations.

13. The kit of claim 11, wherein said extension pole is one fixed length, or is a series of shorter, connectable lengths, or is telescopic.

* * * * *